United States Patent [19]

Schweinsberg

[11] 3,982,747

[45] Sept. 28, 1976

[54] SKI POLE

[75] Inventor: Hubert Schweinsberg, Bergneustadt, Germany

[73] Assignee: Joseph Stamm KG, Rebbelroth, Germany

[22] Filed: Apr. 11, 1975

[21] Appl. No.: 567,362

[30] Foreign Application Priority Data

Apr. 11, 1974 Germany ..... 2417959

[52] U.S. Cl. ..... 280/11.37 H; 24/230 AL

[51] Int. Cl.[2] ..... A63C 11/22

[58] Field of Search ..... 280/11.37 H, 11.37 B, 280/11.37 R, 11.37 D, 11.37 F; 24/201 TR, 230 AL, 244

[56] References Cited

UNITED STATES PATENTS

| | | | |
|---|---|---|---|
| 2,635,317 | 4/1953 | Harley | 24/230 AL |
| 3,163,436 | 12/1964 | Shride et al. | 280/11.37 H |
| 3,378,273 | 4/1968 | Lewis et al. | 280/11.37 H |
| 3,540,751 | 11/1970 | Pierce | 280/11.37 H |
| 3,658,356 | 4/1972 | Van Reyper | 280/11.37 H |
| 3,704,633 | 12/1972 | Iverson | 24/201 TR |

*Primary Examiner*—M. H. Wood, Jr.
*Assistant Examiner*—David M. Mitchell
*Attorney, Agent, or Firm*—Millen, Raptes & White

[57] ABSTRACT

The invention relates to a ski pole and handle comprising a handstrap releasible from the handle to prevent injury to a skier. The handstrap comprises plate means adapted to be inserted in slot means of the handle. The plate means are retained in the handle by a pressure adjustable release means. The release means can comprise spring-biased ball means engaging a hole in the plate means. Biasing pressure of the spring means is adjustable by means of an element engaging said spring means and which is threaded and adjustable in the handle.

7 Claims, 2 Drawing Figures

SKI POLE

BACKGROUND OF THE INVENTION

This invention relates to ski poles and more particularly to a ski pole with a handle and detachable handstrap.

Conventional ski poles conventionally contain a handle to which a handstrap is firmly attached. If the ski pole is improperly used by the skier, the skier falls, etc., it is possible that the skier's wrist may incur injury.

BRIEF SUMMARY OF THE INVENTION

An object of this invention is to provide a ski pole comprising a novel handle and detachable handstrap whereby the danger of injury to a skier is extensively avoided.

Another object of the invention is to provide a ski pole comprising a handstrap mounted to a handle by means of an adjustable release mechanism, wherein the handstrap is released from the handle of the ski pole when a predetermined stress is exceeded on the mechanism.

A further object of this invention is to provide an inexpensive and simple mechanism comprising a handstrap attached to a release member which can be inserted into and held in place by adjustable resilient means disposed in a slot of the handle of the ski pole, whereby the release member can be released therefrom at a predetermined adjustable stress.

Another object of this invention is to provide a ski pole comprising a handle to which a handstrap is detachably mounted by means of a plate-shaped release member having a circular recess, which is inserted in a slot of the handle containing spring-biased ball means.

The above objects along with others will be readily apparent by referring to the following description and claims of a preferred embodiment thereof, taken in conjunction with the accompanying drawing.

DETAILED DESCRIPTION OF THE INVENTION

Figure 1:
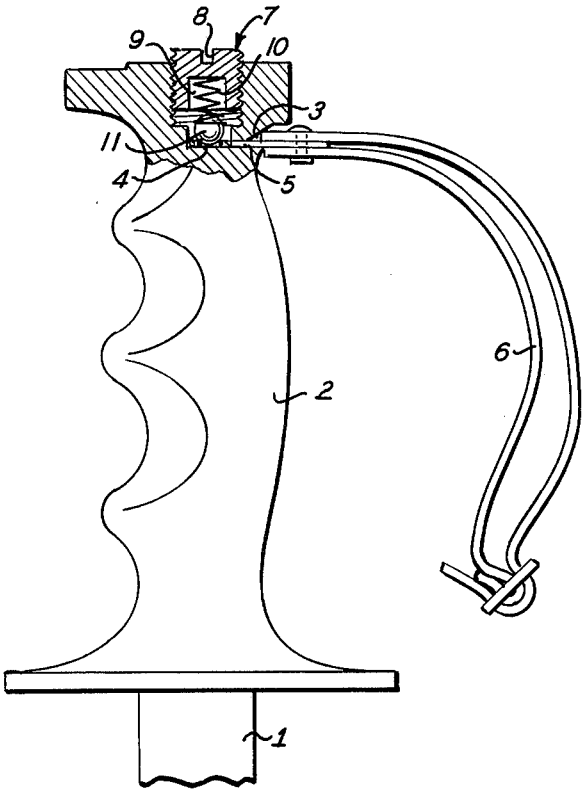
FIG. 1 is a fragmentary, side elevational view, partially in section, of the upper portion of the ski pole of the present invention.
Figure 2:
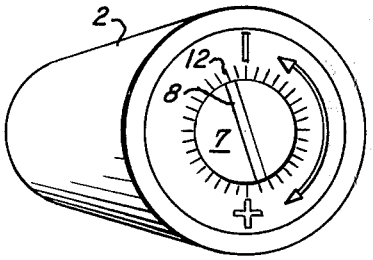
FIG. 2 is a top plan view of the ski pole shown in FIG. 1.

Referring to the drawing, the numeral 1 denotes a conventional ski pole and the numeral 2 denotes a conventional handle, both secured to each other. Near the upper portion of handle 2, a slot 3 is disposed transversely to the pole axis. Slot 3 is adapted to receive a plate member 5 containing a recess or hole 4. Handstrap 6 is secured or connected by suitable means to a preferably flat plate member 5.

Figure 3:
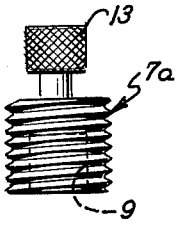
FIG. 3 is a side view of an alternative adjusting element.

The upper portion of handle 2 has a threaded bore, which is parallel to the axis of the pole, and which extends to and communicates with slot 3. A threaded adjusting element 7 is adapted to be screwed in the threaded bore. Element 7 has disposed at its top, means for turning it in the threaded bore. As shown, a slot 8 is provided for turning and adjusting the element 7 in the threaded bore. Alternatively, a knurled knob 13 can be provided in place of the slot 8, as shown in element 7*a* of FIG. 3.

Element 7 is provided with a recess or hole 9 on its underside in which a spring 10 is disposed. With plate 5 disposed in slot 3, a ball 11 is biased against spring 10, and is in engagement with hole 4 of the plate. The biasing pressure of the spring 10 and ball 11 in hole 4, is determined by the amount that the adjusting element 7 is turned inwardly or outwardly within the threaded bore.

It is readily apparent that if handstrap 6 is subjected to a pulling force greater than the biasing pressure of the spring and ball 11 in hole 4, that the plate 5 will be pulled out of and released from slot 3. Plate 5 can be reinserted readily in slot 3 by pushing the plate inwardly with sufficient force to overcome the biasing pressure of the spring and ball to permit seating of the ball in hole 4. The reinsertion can also be accomplished by moving adjusting element 7 outwardly to lessen the biasing pressure of the spring and ball.

The amount of release force required to overcome the biasing pressure of the spring and ball can be adjusted by turning adjusting element 7 to obtain a desired release force. To obtain a reproducible release force, the top of the handle 2 is provided with a series of markings 12, whereby the slot or a suitable indicator on the top of element 7 can be turned and set to the appropriate marking 12.

The above described handstrap and release mechanism provided in the handle of the ski pole, provides a means for preventing injury to a skier when the ski pole is improperly handled or when there is loss of control thereof. Thus, when a predetermined pulling force is applied to the handstrap, plate 5 and the handstrap will be disengaged from the handle of the ski pole.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A ski pole comprising a handle and a handstrap releasably attached to said handle, said handle comprising longitudinal threaded bore means in the upper part thereof, threaded element means adapted to be screwed and for adjustment in said bore means and comprising longitudinal recess means disposed in its underside adapted to receive and contain longitudinal, biasing resilient element means, ball means disposed at the end of said resilient means, slot means in said handle disposed laterally to and communicating with said bore means, said handstrap comprising release means adapted to engage said slot means, said release means comprising recess means adapted to have said ball means engaged therein at a predetermined biasing pressure to retain said release means in said slot means, whereby said release means and handstrap are releasable from said handle when said biasing pressure is exceeded.

2. The ski pole of claim 1 wherein said resilient element means are spring means.

3. The ski pole of claim 1 wherein said release means is plate means comprising a circular recess.

4. The ski pole of claim 1 wherein said release means is plate means comprising a hole.

5. The ski pole of claim 1 wherein said threaded element means is adjustable in said threaded bore to enable adjustment of the biasing pressure of said resilient element means.

6. The ski pole of claim 1 wherein said threaded element means comprises external slot means for turning thereof.

7. The ski pole of claim 1 wherein said threaded element means comprises a protruding knurled knob for turning thereof.

* * * * *